US008789987B2

(12) United States Patent
Nölle

(10) Patent No.: US 8,789,987 B2
(45) Date of Patent: Jul. 29, 2014

(54) BASE FOR MASTS

(76) Inventor: Jürgen Nölle, Rheinberg (DE)

( * ) Notice: Subject to any disclaimer, the term of this patent is extended or adjusted under 35 U.S.C. 154(b) by 0 days.

(21) Appl. No.: 13/640,485

(22) PCT Filed: Apr. 12, 2011

(86) PCT No.: PCT/DE2011/000391

§ 371 (c)(1),
(2), (4) Date: Oct. 11, 2012

(87) PCT Pub. No.: WO2011/127904

PCT Pub. Date: Oct. 20, 2011

(65) Prior Publication Data

US 2013/0027911 A1 Jan. 31, 2013

(30) Foreign Application Priority Data

Apr. 14, 2010 (DE) ..... 10 2010 014 989

(51) Int. Cl.

| | |
|---|---|
| ***F21V 21/06*** | (2006.01) |
| ***F21S 9/02*** | (2006.01) |
| ***F21V 23/00*** | (2006.01) |
| ***E04H 12/22*** | (2006.01) |
| *F21V 21/22* | (2006.01) |

(52) U.S. Cl.

CPC ..... *F21V 21/06* (2013.01); *F21V 21/22* (2013.01); *F21V 23/00* (2013.01); *F21S 9/02* (2013.01); *E04H 12/2246* (2013.01)

USPC ..... 362/431; 362/101; 362/190; 362/382; 362/192; 362/193; 362/458; 362/153; 362/153.1

(58) Field of Classification Search

USPC ..... 362/101, 382, 190, 431, 96, 458, 157, 362/414, 153, 153.1, 192, 193; 248/519

See application file for complete search history.

(56) References Cited

U.S. PATENT DOCUMENTS

| | | | | |
|---|---|---|---|---|
| 2,899,540 | A * | 8/1959 | Allmand et al. | 362/192 |
| 4,543,905 | A * | 10/1985 | McKenney | 116/63 P |
| 5,086,583 | A * | 2/1992 | Breen | 47/40.5 |
| 5,944,413 | A * | 8/1999 | Crookham et al. | 362/431 |
| 6,117,027 | A * | 9/2000 | Davis et al. | 473/481 |
| 6,299,124 | B1 * | 10/2001 | Reback et al. | 248/519 |
| 6,453,635 | B1 * | 9/2002 | Turner | 52/848 |
| 6,986,496 | B2 * | 1/2006 | Woude et al. | 248/519 |
| 7,429,139 | B2 * | 9/2008 | Wesselink et al. | 396/427 |

FOREIGN PATENT DOCUMENTS

| | | |
|---|---|---|
| DE | 3226220 A1 | 1/1984 |
| DE | 10036998 A1 | 2/2002 |
| DE | 202006003261 U1 | 6/2006 |

* cited by examiner

*Primary Examiner* — Diane Lee
*Assistant Examiner* — Mitchell Errett
(74) *Attorney, Agent, or Firm* — Michael Soderman

(57) ABSTRACT

The invention relates to a base (1), in particular for light masts, comprising a housing (7) with a base surface (10) which can be filled with a medium. In order to ensure improved stability and to avoid additional grounding measures, an embodiment is chosen according to the invention in which the housing (7) is not electrically conductive and has a holding opening (21) for a mast (2) which is not round and is composed of non-conductive material. In this case, a mast (2) which is not round avoids lateral inclination of the mast (2), thus making it possible to ensure secure installation.

10 Claims, 6 Drawing Sheets

BASE FOR MASTS

CROSS REFERENCE TO RELATED APPLICATIONS

This application is the U.S. national stage of International Application No. PCT/DE2011/000391, filed on Apr. 12, 2011, and claims the benefit thereof. The international application claims the benefits of German Application No. DE102010014989.6 filed on Apr. 14, 2010; all applications are incorporated by reference herein in their entirety.

BACKGROUND

1. Field of Use of the Invention

The invention relates to a base, in particular for light masts, comprising a housing with a base surface that can be filled with a medium.

2. Prior Art

Generic bases are known for sunshades, for instance; a plastic base that has a fairly large base surface is usually involved. The plastic container can be filled with a medium in connection with this, for instance sand or water, so that its own weight is increased and reliable stability of the sunshade is ensured. Fairly small sunshades with a diameter of less than 1.50 m are usually involved here, so the requirements on the base are not particularly high. If larger sunshades are used, in contrast, a pipe that is solidly sunk into the ground, that the mast can be inserted into, is utilized as a rule. Furthermore, various possibilities exist to prevent the sunshade from tipping over via additional anchoring measures. The low weight of the base itself and the danger of tipping over resulting from that are viewed as drawbacks here with regard to bases for sunshades.

The anchoring of a sunshade and, analogous to that, of masts, especially light masts, also proves to be extremely difficult and time-consuming. When it is necessary to quickly change the position of a light mast, for instance, the required setup and dismantling work is a crucial time factor that significantly limits the use of the light masts. Light masts mounted on trailers that are moved into the required position with the aid of a tractor are very frequently used for that reason; adequate support stability of the trailer has to also be ensured via anchoring measures in that case, for instance when the trailer is only supported on an axle. On the other hand, if larger trailer bodies with at least two axles are involved, they only have to be locked in place at the desired setup location. If trailers with light masts are used, they require adequate space for the tractor so that the required maneuvering work can be done.

In the end, the trailers have to be moved into the desired position with muscle power over and over again as a rule here. That could be necessary, as an example, when the space requirements are not met. The trailer with the light mast has to be capable of being quickly set up and likewise quickly removed once again as far as that is concerned to avoid a risk of accidents and risk to the personnel. That is a decisive criterion at highway construction sites, for instance. A further problem results from this that electrically conducting materials have to be grounded. It is consequently necessary for all of the electrically conducting materials of a trailer, for example, that are not grounded, as is well known, due to the use of rubber tires, to be additionally grounded via suitable measures.

SUMMARY

The present invention distinguishes itself by the fact that a new type of base has been created that requires no grounding measures at all and, moreover, has significantly greater inherent stability vis-a-vis known design variants because of the use of a nonconducting housing for the base and a likewise nonconducting mast made of fiberglass that also has a noncircular cross-section.

DETAILED DESCRIPTION

The present invention is based on the problem of presenting a new type of base that avoids the drawbacks from the prior art, that offers the possibility of a quick change in locations and that does not need additional grounding measures. To solve the problem in accordance with the invention, there are provisions for the housing to be designed to be electrically nonconductive and for it to have a holding opening for a noncircular mast made of a nonconducting material. Further advantageous design forms follow from the subclaims.

Additional grounding of the housing is no longer required in an advantageous way here because of the use of a base with a housing that is designed to be electrically nonconductive. The expenses for functional inspections of the electrical system according to VDE [Electricians' Association], as an example, are eliminated because of this. Grounding of the mast is likewise no longer necessary as far as this is concerned because of the use of a noncircular mast that is also made of a nonconducting material.

The light masts are preferably made of a light construction material that does not consist of a solid material as a preference, but instead of a tubular material, to make it as easy as possible to set up the mast, especially light masts, without the use of substantial physical efforts via muscle power being required, for instance. The focus is deliberately on a noncircular mast here, because round, hollow-walled masts are extremely flexible and could therefore tilt to one side. This risk especially exists when a large-volume lamp is arranged in the upper area. An extremely strong tilt could therefore arise because of the lamp's own weight, depending on the prevailing wind circumstances, so additional anchoring means would have to be used. If a noncircular mast is used, however, it would have substantially greater stability and would absolutely not have a tendency towards extreme bending to the side.

A great many advantages are consequently unified via the characteristic elements of the subject matter of the invention and, in fact, an electrically nonconductive housing and an electrically nonconductive mast, which are also used in a noncircular version on top of that; this specifically leads to a situation in which the base with a light mast can be very quickly moved and, moreover, additional anchoring measures and grounding measures can be avoided. That is especially advantageous when the light masts have to be set up at a highway construction site, for instance, where there is not much space as a rule for an additional anchoring of the light mast. The same applies to construction sites when the light masts have to be set up close to an excavation pit or in the excavation pit itself, for example, and anchoring measures that may be needed will hinder the work to be carried out. Alternatively, the base can also be used for masts of floodlights, traffic lights, signs and traffic signs (illuminated and non-illuminated).

If the bases as per the invention with light masts or other masts with traffic lights or the like are to be set up close to vehicles driving by, especially at highway construction sights, there are further provisions for the housing to be rounded in the front in such a way that no flat surface exists with the exception of the base surface and a reduced surface around the holding opening of the mast in parallel with that. This means that the housing itself has a rounded construction in the front, meaning against the direction of travel of the flowing traffic, to the effect that no projecting edges exist, in order to significantly limit the risk to persons in the event of an accident, especially of a collision with the base. Instead, because of the design with a rounded housing front, a situation is achieved in which colliding vehicles will be tangentially diverted and the base can be moved by the impact if necessary. Even in the case of a head-on collision, the rounded housing shape prevents projecting corners and edges from being able to penetrate into the interior of the vehicle, for instance, which significantly reduces the risk of injury.

There are provisions in a further design form of the invention for the housing to have an installation area in the rear for an energy supply unit that is at least partially bordered by lateral upturned edges or that is additionally held in place with lateral support struts and/or guide straps. The installation area that is formed in the rear area of the housing, which is freely accessible from the outside, offers the possibility of seating energy supply units on this base surface and replacing them at any time. Rechargeable batteries or electrical power generators could be involved here. Since the installation area is located in the rear of the housing, and thus in the direction of travel, the energy supply unit is protected, on the one hand, by the rounded housing in the front and, on the other hand, a direct collision is avoided between a vehicle and the energy supply unit.

There are provisions regarding the transport of the bases in a further advantageous design form of the invention for the housing to have a base surface subdivided in the longitudinal direction that has recesses at intervals to seat forklift truck prongs. The width and height of the recesses are adapted to the customary size of the forklift truck prongs here, so the housing can be picked up together with the mast with the aid of a forklift truck or a manual pallet-lifting truck and very easily brought to a different location.

To further increase the support stability of the base with the mast, there are provisions for the base surface of the housing to have a slip resistant coating or overlay. The slip resistant coating prevents the base from tending towards movement on its own due to a slightly sloping arrangement, and it consequently increases the support stability. Furthermore, it is ensured that the base will only move over a short path, if at all, when possible contact is made with the base by vehicles or the like.

The housing of the base is transported in an empty state when it is sent to a construction site or other work location because its own weight is possibly high and it can be filled at the site where it is used. A filling inlet and outlet that can be screwed tight is provided for the medium for that reason; that will preferably be water as an example. A simple filling process for the housing can consequently take place on site with the aid of a garden house or the like and, just as easily, an opportunity exists to drain the medium out of the housing beforehand when the bases are removed, in order to obtain significant weight savings.

An essential idea of the present invention is that the holding opening of the mast is designed to be noncircular. A polygonal variant is used as a preference here, because it has significantly greater internal stability and does not have a tendency towards natural oscillation or a lateral tilt. Polygonal masts have significantly greater inherent stability. A square or hexagonal embodiment of the mast that is made out of fiberglass, as an example, is a possibility here in an especially preferred design form.

Depending on the purpose for which the light mast is used, this mast can be made up of several mast elements that can be inserted in one another, making an individual height adjustment possible.

There are provisions in a further design form of the invention for the housing to be able to hold from 100 to 300 liters, preferably 200 to 280 liters, of a liquid medium. Depending on the lamps that are intended to be used in the light mast and the desired height at which the lamps will be attached, the housing can be manufactured in different sizes with a capacity of 100 to 300 l; a size with a capacity of 200 to 280 liters is preferred, because this housing size offers adequate stability for a mast made of fiberglass with lamps that are nearly round, for instance. The lamp itself can be made of a gas balloon with bulbs here or a mechanically spread-out balloon cover that surrounds the bulbs. There are preferably provisions here for the housing to be made of a nonconducting plastic to rule out other grounding measures and, furthermore, for fiberglass to be used for the mast as a preference so that neither the base nor the light mast will require special grounding measures.

BRIEF DESCRIPTION OF THE DRAWINGS

The invention is explained once again below with the aid of the figures.

DETAILED DESCRIPTION OF THE PREFERRED EMBODIMENT

Figure 1:
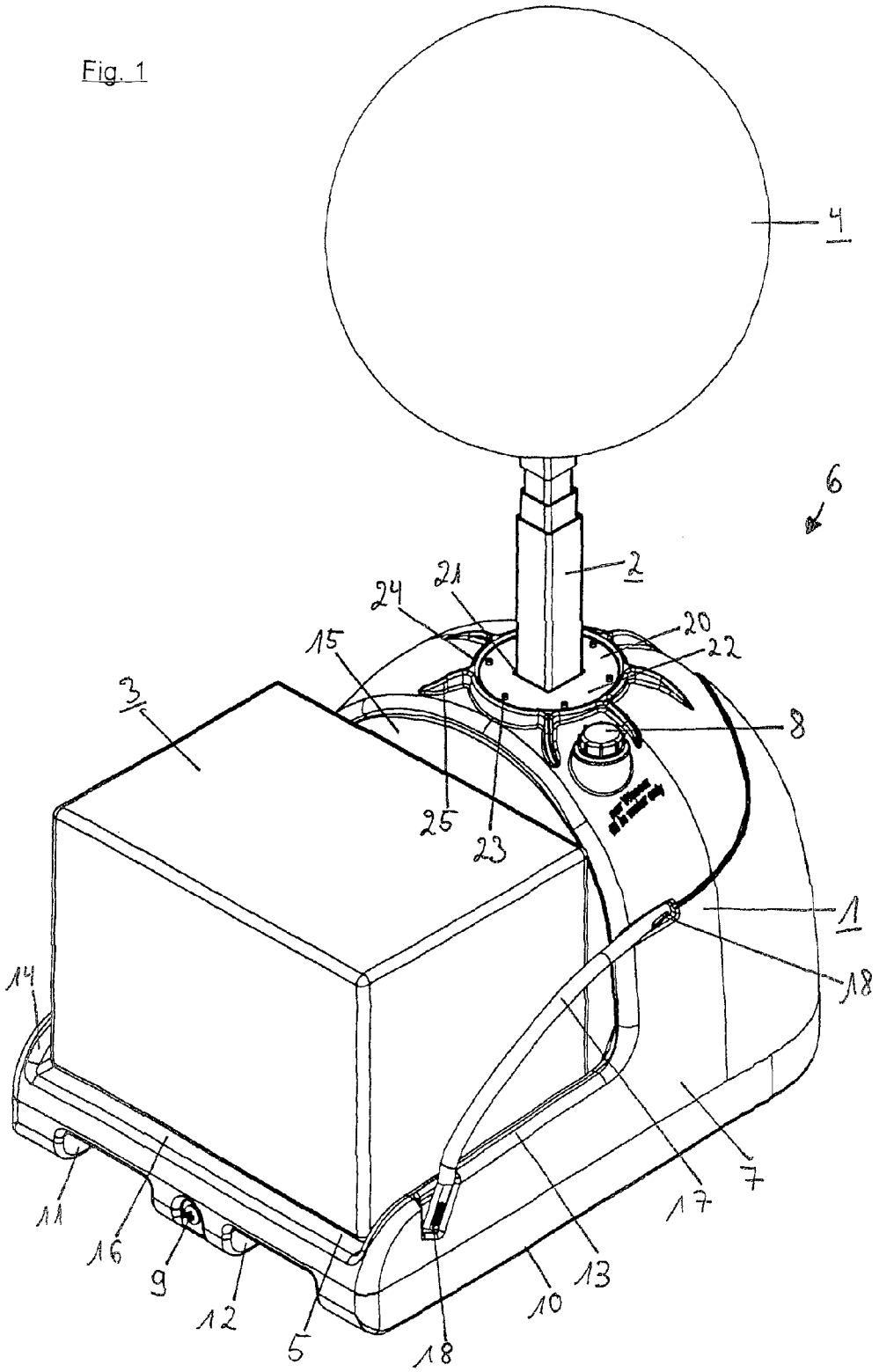
FIG. 1 shows a base as per the invention with a mast and lamp, as well as an energy supply unit, in a perspective view.

FIG. 1 shows a base 1 as per the invention with a mast 2 and an energy supply unit 3 in a perspective view. The inserted mast 2 supports a lamp 4 that is symbolically shown as a ball in this case. Both a gas balloon with lamps and a mechanically spread-out balloon cover with lamps could be involved here. Alternatively, the base can also be used for floodlights, traffic lights, signs and traffic signs (illuminated and non-illuminated). The energy supply unit 3 is likewise only symbolically shown in the form of a rectangular box. The energy supply unit 3 could be comprised of a battery module or an electrical power generation module, for example, and it is set down on a rear installation area 5. The installation area 5 is dimensioned in such a way here that sufficient battery capacity or a sufficient electrical power supply by a generator is possible. The base 1 itself is made of a plastic material that is designed to be round in the front 6 to avoid a possible risk of injury for colliding vehicles and their passengers.

The base 1 is comprised of a housing 7 here that can be filled with a medium, for instance water, via a filling inlet 8. Furthermore, an outlet 9 is provided so that the ballast water can be drained for removal of the base 1. Since the base 1 is dimensioned with a large volume, the housing 7 can hold around 100 to 300 liters of water; different sizes can be made available for different requirements. The height of the mast 2 and the weight of the lamp 4 are decisive in connection with that.

The housing 7 has a base surface 10 with recesses 11 and 12 at intervals. The width and the height of the recesses 11 and 12 are chosen in such a way that an opportunity exists, for instance with the aid of a forklift truck and, in fact, with the forklift truck prongs, to move into the recesses 11 and 12 and lift the entire base; the filled base with a mast 2 and lamp 4 can also be transported to a different site.

The installation area 5 has lateral upturned edges 13 and 14, which prevent lateral slippage of the energy supply unit 3, to hold the energy supply unit 3 in place. Furthermore, the energy supply unit 3 is held in place with the rear wall 15 of the rounded housing 7 and a further upturned edge 16. Lateral straps 17 additionally secure the energy supply unit 3, but essentially serve to aid in the transport of an empty base 1 by hand. The ends of the straps 17 are connected via fastening elements 18 to the housing 7 for that reason. A flat, circular area 20 that has a square holding opening 21 is formed at the highest position of the rounded housing 7. The bottom mast element of the mast 2, which likewise has a square design, is inserted into the square holding opening 21 and anchored inside of the housing 7. The area 20 is additionally reinforced with a cover 22 with the aid of screw bolts 23 here. Furthermore, a collar 24 that transitions into lateral reinforcement ribs 25 is formed around the area 20. Several of these reinforcement ribs 25 are arranged around the circumference of the area 20, giving the area 20 a firm connection to the housing 7.

Figure 2:
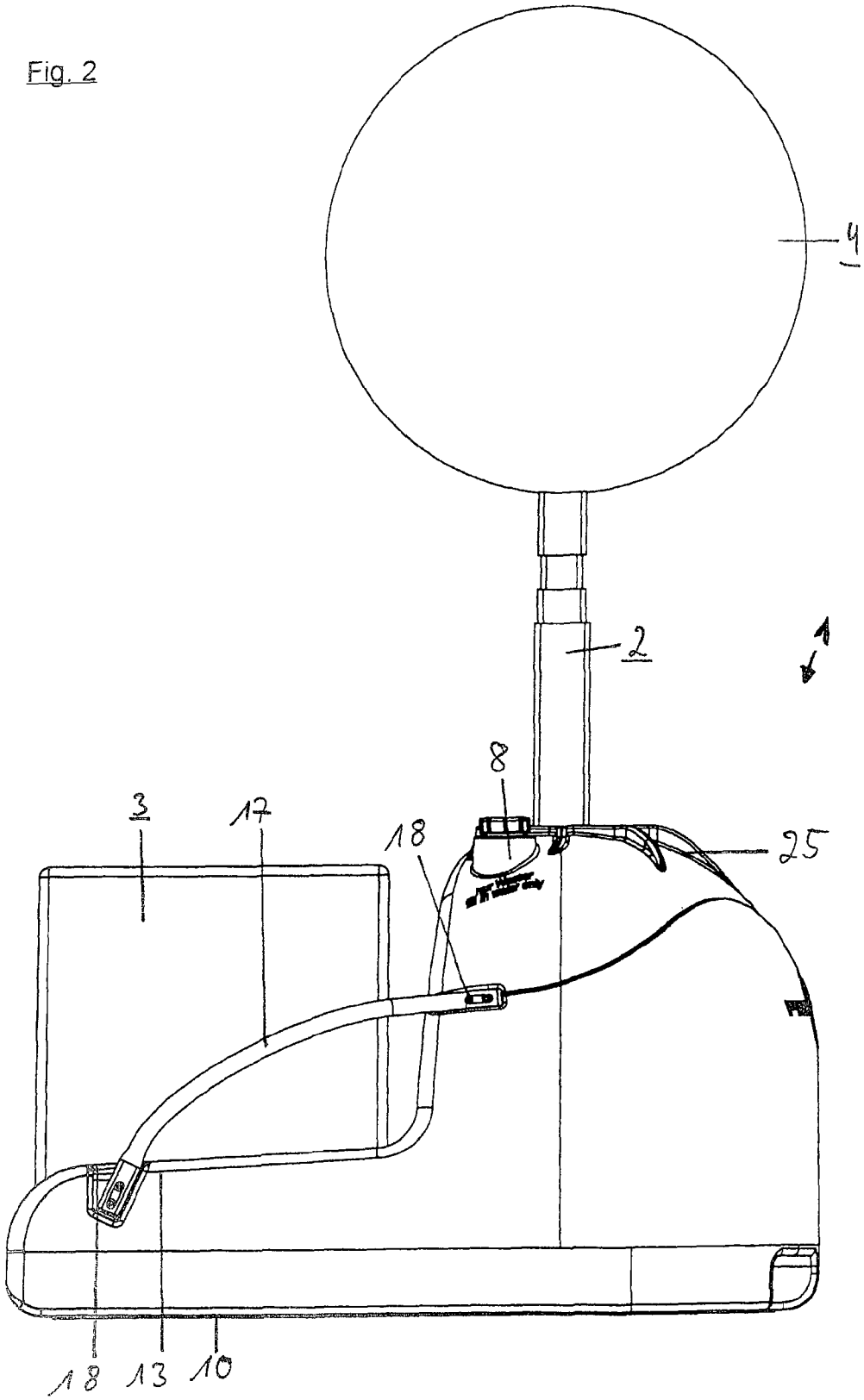
FIG. 2 shows the base known from FIG. 1 in a side view.

FIG. 2 shows the base 1 known from FIG. 1 in a side view with the mast 2, energy supply unit 3 and lamp 4. The structure corresponds to a very great extent to the design form in accordance with FIG. 1.

Figure 3:
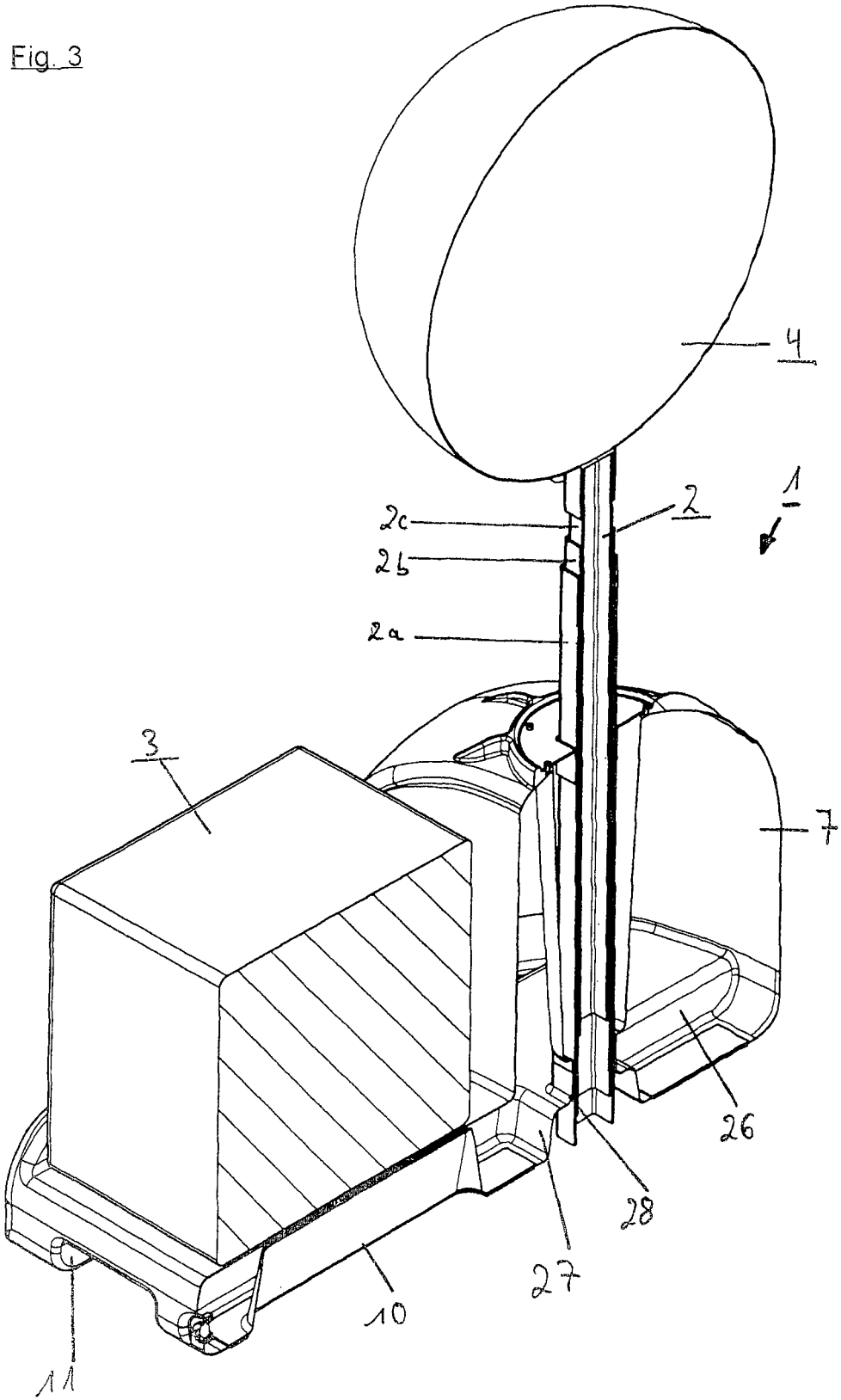
FIG. 3 shows the base known from FIG. 1 in a partially sectional, perspective view.

FIG. 3 likewise shows the base 1 with the mast 2 and energy supply unit 3, as well as the lamp 4, in a section, perspective view. It is evident from this view that the housing 7 is designed to be hollow inside to hold a medium. Furthermore, it is evident that the mast 2 with its bottom mast element 2*a* projects through the housing 7 to the bottom part 26 and is additionally held in place in the lower area in an upturned reinforcement edge 27 of the housing 7 with a square opening 28. Consequently, the bottom mast element 2*a* is held in place in the lower area and in a higher area and serves, moreover, to seat the insertable mast elements 2*b* and 2*c*.

Figure 4:
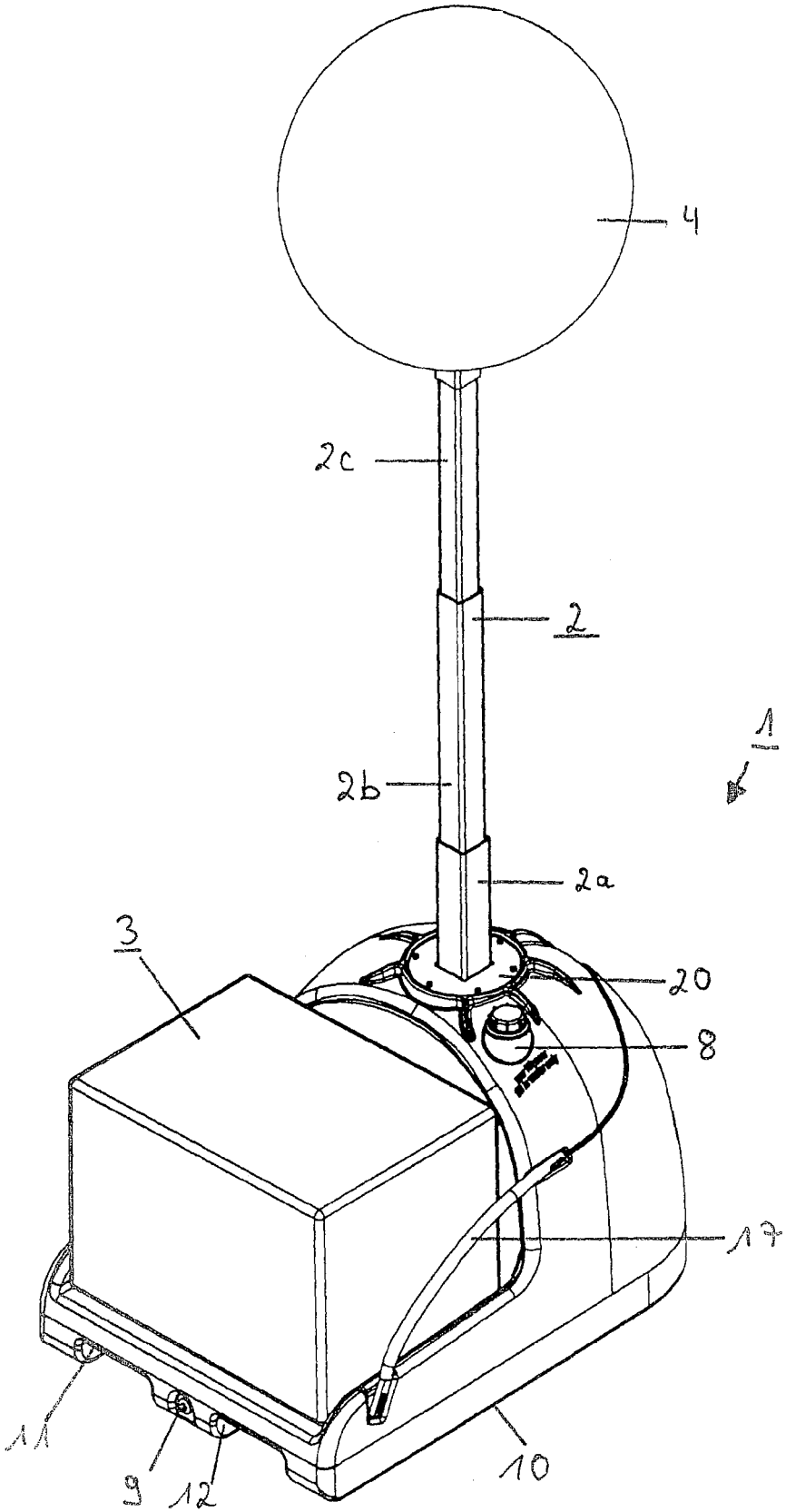
FIG. 4 shows the base known from FIG. 1 with an extended, multi-part mast in a perspective view.

FIG. 4 shows the base 1 known from FIG. 1 with the energy supply unit 3 and the lamp 4 in a perspective view with an extended mast 2. The structure of the base 1 is identical to that of FIG. 1; the position of the lamp 4 has merely been raised by the extended mast 2 with its mast elements 2*a*, 2*b* and 2*c* so that a larger surrounding area can be illuminated by the lamp 4.

Figure 5:
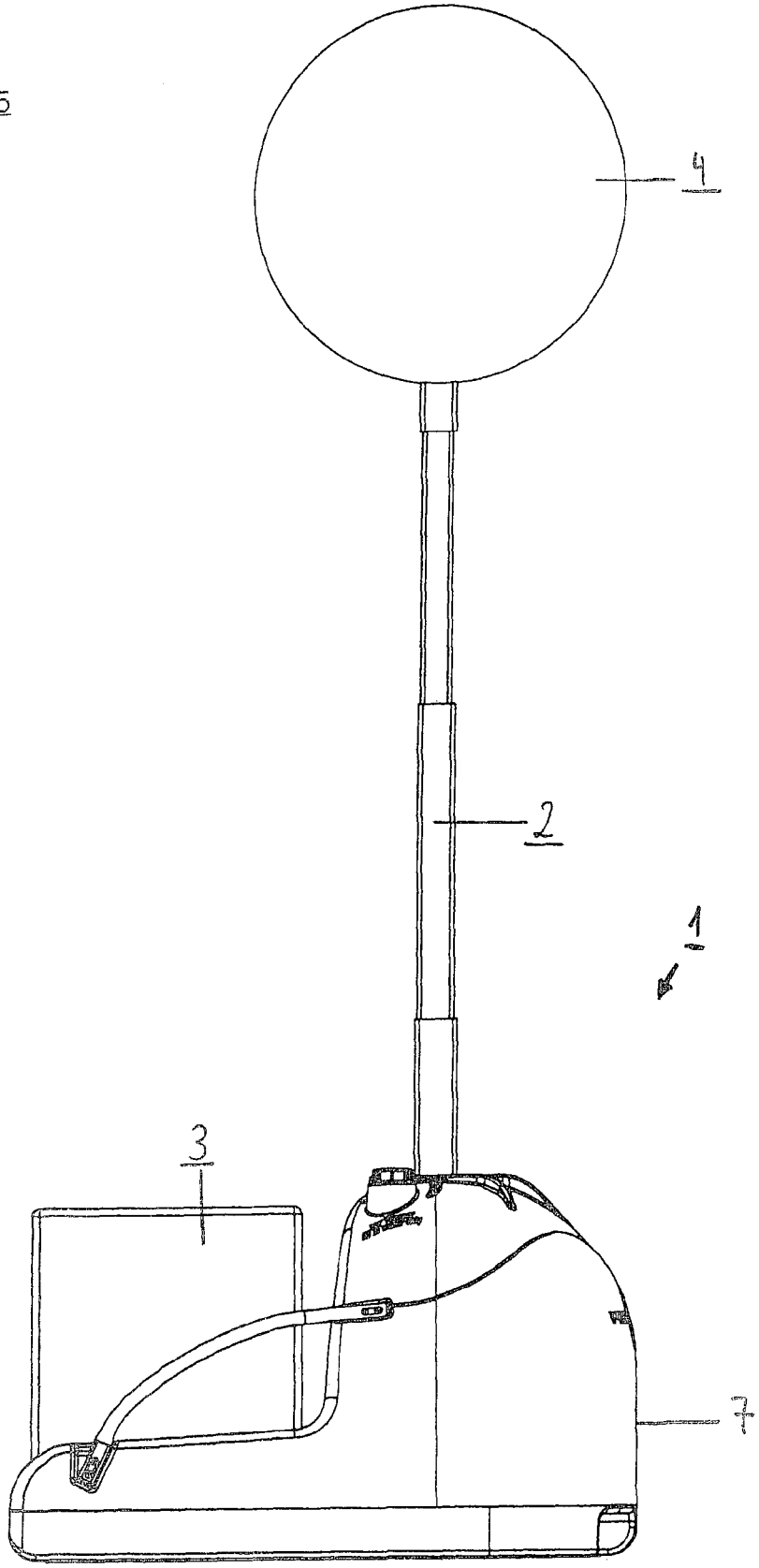
FIG. 5 shows the base known from FIG. 4 in a side view.

FIG. 5 shows the base 1 known from FIGS. 1 and 4 in a side view with the energy supply unit 3 and lamp 4, as well as an extended mast 2 in accordance with FIG. 4.

Figure 6:
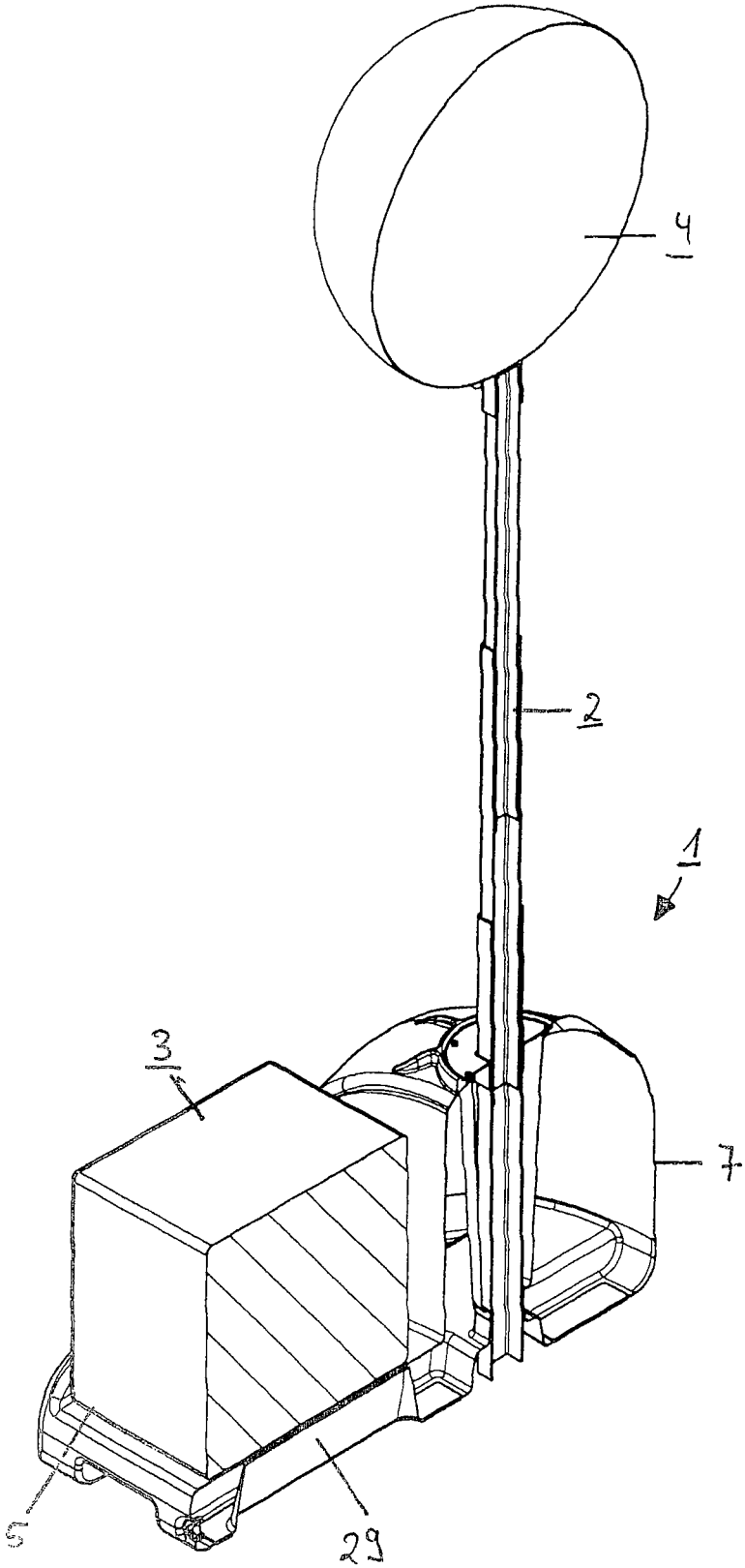
FIG. 6 shows the base known from FIG. 4 once again in a partially sectional, perspective view.

FIG. 6 shows the extended mast 2, which is supported in the housing 7 of the base 1 and which supports a lamp 4 at the upper end, in a sectional, perspective view. The housing 7 with the energy supply unit 3 corresponds to a very great extent, moreover, to the design form of the previous figures; it is especially evident in this figure that the installation area 5 provided for the energy supply unit 3 has a reinforced bottom area 29 for the energy supply unit 3.

LIST OF REFERENCE NUMERALS

1 Base
2 Mast/light mast 2*a* Mast element
2*b* Mast element
2*c* Mast element
3 Energy supply unit
4 Lamp
5 Installation area
6 Front
7 Housing
8 Filling inlet
9 Outlet
10 Base surface
11 Recess
12 Recess
13 Upturned edge
14 Upturned edge
15 Rear wall
16 Upturned edge
17 Guide straps
18 Holding element
20 Area
21 Holding opening
22 Cover
23 Screw bolts
24 Collar
25 Reinforcement ribs
26 Bottom part
27 Upturned reinforcement edge
28 Opening
29 Bottom area

The invention claimed is:

1. Base, especially for light masts, comprising: a housing with a base surface filled with a medium and that has a holding opening for a mast, said housing and said mast being comprised of an electrically nonconductive material, wherein the mast has a non-circular cross-section and the housing has two different housing sections, a first housing section with the holding opening on top and a rounded surface curving outwards from the holding opening down to the base surface, the rounded surface truncated by a plane perpendicular to the base surface on one side of the holding opening, and a second housing section connected to the rounded surface of the first housing section on the side truncated by the plane, the second housing having an installation area in a flat design and parallel to the base surface for an energy supply unit.

2. Base according to claim 1, wherein the installation area is at least partially bordered by lateral upturned edges or that is held in place with lateral support struts or guide straps.

3. Base according to claim 1, wherein the base surface of the housing is subdivided in the longitudinal direction that has recesses at intervals to seat forklift truck prongs.

4. Base according to claim 1, wherein the base surface of the housing has a slip resistant coating or overlay.

5. Base according to claim 1, wherein the housing has a filling inlet and outlet that can be screwed tight for the medium.

6. Base according to claim 1, wherein the holding opening of the housing for the mast is designed to be polygonal.

7. Base according to claim 1, wherein the mast is made of fiberglass that supports a lamp on the other end.

8. Base according to claim 1, wherein the housing can be equipped with a generator or a battery unit on the installation area.

9. Base according to claim 1, wherein the housing is designed to hold from 100 to 300 liters of a liquid medium.

10. Base according to claim 1, wherein the housing is made of a nonconductive plastic.

* * * * *